US008275611B2

(12) United States Patent
Zong et al.

(10) Patent No.: US 8,275,611 B2
(45) Date of Patent: Sep. 25, 2012

(54) ADAPTIVE NOISE SUPPRESSION FOR DIGITAL SPEECH SIGNALS

(75) Inventors: Wenbo Zong, Singapore (SG); Yuan Wu, Singapore (SG); Sapna George, Singapore (SG)

(73) Assignee: STMicroelectronics Asia Pacific Pte., Ltd., Singapore (SG)

( * ) Notice: Subject to any disclaimer, the term of this patent is extended or adjusted under 35 U.S.C. 154(b) by 1269 days.

(21) Appl. No.: 12/009,601

(22) Filed: Jan. 18, 2008

(65) Prior Publication Data

US 2008/0189104 A1 Aug. 7, 2008

Related U.S. Application Data

(60) Provisional application No. 60/881,028, filed on Jan. 18, 2007.

(51) Int. Cl.
*G10L 19/14* (2006.01)

(52) U.S. Cl. ..... 704/225; 704/200.1; 704/201; 704/208; 704/233

(58) Field of Classification Search ..... None
See application file for complete search history.

(56) References Cited

U.S. PATENT DOCUMENTS

| | | | | |
|---|---|---|---|---|
| 5,757,937 | A * | 5/1998 | Itoh et al. | 381/94.3 |
| 6,088,668 | A * | 7/2000 | Zack | 704/225 |
| 6,317,709 | B1 * | 11/2001 | Zack | 704/225 |
| 6,415,253 | B1 * | 7/2002 | Johnson | 704/210 |
| 6,487,535 | B1 * | 11/2002 | Smyth et al. | 704/500 |
| 2002/0012429 | A1 * | 1/2002 | Matt et al. | 379/406.01 |
| 2003/0055627 | A1 * | 3/2003 | Balan et al. | 704/200.1 |
| 2004/0101038 | A1 * | 5/2004 | Etter | 375/222 |

* cited by examiner

*Primary Examiner* — Leonard Saint Cyr

(57) ABSTRACT

An apparatus for adaptively suppressing noise in an input signal frequency spectrum derived from overlapping input frames is provided. The system includes a psychoacoustic power computation module configured to compute a noisy signal power in psychoacoustic bands, a voice activity scoring module configured to compute a probabilistic score for a presence of a speech, and a noise estimation module configured to estimate a noise power in the psychoacoustic bands based on information of past frames, the probabilistic score, and the computed noisy signal power. The system also includes a gain computation module configured to compute a gain for each frequency, based on a probabilistic heuristic, the probabilistic score and the information on the past frames, and a gain post-processing module configured to perform a gain time smoothing, a gain frequency smoothing, and a gain regulation for the computed gain.

20 Claims, 5 Drawing Sheets

ADAPTIVE NOISE SUPPRESSION FOR DIGITAL SPEECH SIGNALS

CROSS-REFERENCE TO RELATED APPLICATION AND CLAIM OF PRIORITY

The present application is related to U.S. Provisional Patent No. 60/881,028, filed Jan. 18, 2007, entitled "ADAPTIVE NOISE SUPPRESSION FOR DIGITAL SPEECH SIGNALS". U.S. Provisional Patent No. 60/881,028 is assigned to the assignee of the present application and is hereby incorporated by reference into the present disclosure as if fully set forth herein. The present application hereby claims priority under 35 U.S.C. §119(e) to U.S. Provisional Patent No. 60/881,028.

TECHNICAL FIELD

The disclosure relates generally to audio signal processing, and in particular to suppressing additive noise in a speech signal in a communication system.

BACKGROUND

In many communication applications, an additive background noise signal is introduced into the speech signal. The corrupted speech signal, or noisy speech signal, often poses difficulties for the receiving party, such as degraded quality or reduced intelligibility. For instance, when having a conversation over the mobile phone in a driving car or on a busy street, the background noise is often high enough to make the conversation far less efficient than in a quiet room. It is hence often desired to remove the corrupting noise either before the noisy signal is transmitted at the sender or before the received noisy signal is played out at the receiver.

SUMMARY

Embodiments of the present disclosure relate to a system and method that rates the voice activity with a continuous score, and adaptively estimates the noise power in psychoacoustic bands and accordingly adjusts the noisy signal spectrum based on probabilistic heuristics to suppress the noise in a speech signal.

In one embodiment, an apparatus for adaptively suppressing noise in an input signal frequency spectrum derived from overlapping input frames is provided. The system includes a psychoacoustic power computation module configured to compute a noisy signal power in psychoacoustic bands, a voice activity scoring module configured to compute a probabilistic score for a presence of a speech, and a noise estimation module configured to estimate a noise power in the psychoacoustic bands based on information of past frames, the probabilistic score, and the computed noisy signal power. The system also includes a gain computation module configured to compute a gain for each frequency, based on a probabilistic heuristic, the probabilistic score and the information on the past frames, and a gain post-processing module configured to perform a gain time smoothing, a gain frequency smoothing, and a gain regulation for the computed gain.

In another embodiment, a method for adaptively suppressing a noise in an input signal frequency spectrum derived from overlapping input frames is provided. The method includes computing a noisy signal power in psychoacoustic bands, computing a probabilistic score for a presence of a speech, and estimating a noise power in the psychoacoustic bands based on information of past frames, the probabilistic score, and the computed noisy signal power. The method also includes computing a gain for each frequency, based on a probabilistic heuristic, the probabilistic score and the information on the past frames, post-processing the computed gain by performing a gain time smoothing, a gain frequency smoothing, and a gain regulation on the computed gain, and adjusting the input signal frequency spectrum by attenuating a noise in the input signal frequency spectrum based on the post-processed gain.

In yet another embodiment, a computer program embodied on a computer readable medium and operable to be executed by a processor is provided. The computer program includes computer readable program code for converting overlapping input frames into an input signal frequency spectrum, computing a noisy signal power in psychoacoustic bands and computing a probabilistic score for a presence of a speech. The computer program also includes computer readable program code for estimating a noise power in the psychoacoustic bands based on information of past frames, the probabilistic score, and the computed noisy signal power, and computing a gain for each frequency, based on a probabilistic heuristic, the probabilistic score and the information on the past frames. The computer program further includes computer readable program code for post-processing the computed gain by performing a gain time smoothing, a gain frequency smoothing, and a gain regulation on the computed gain and adjusting the input signal frequency spectrum by attenuating a noise in the input signal frequency spectrum based on the post-processed gain.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The problem of removing or suppressing noise corrupting a speech signal in a communication system has been studied for a long time. Reported approaches can be broadly classified into several categories: spectral subtraction, spectral weighting and model based. Spectral subtraction works by estimating the power of additive noise and subtracting it from the noisy signal power to obtain an estimated spectrum of the clean speech, based on the assumption that the corrupting noise is uncorrelated with speech, which is generally true in practice. Special treatment is needed to avoid negative power after subtraction. In spectral subtraction, the phase information is generally taken the same as the noisy signal, as it is found to be less important for perception than power.

Spectral weighting is to obtain a weight for each frequency that corresponds to an optimum filter that minimizes the mean-square error of the processed signal against the desired signal (clean speech), a form of Wiener filter implemented in the frequency domain. It involves estimating the noise power and computing the spectrum of the noisy signal, after which a weighting gain is calculated. These two methods can be considered as special cases of generalized Wiener filtering, and one issue is that it relies on accurate estimation of the noise power.

The model based approach is based on an underlying speech model and has also been investigated in the past. In such approach, the parameters of the model are first estimated and then the speech is generated using the estimated parameters. One issue associated with this approach is that a high level of complexity. The fact that accurate estimation of the model parameters for a noisy signal is itself difficult. Practically, for better accuracy, a higher model order is necessary, which in turns increases the complexity significantly, in some cases exponentially.

There is therefore a need for an improved system and method to adequately suppress the corrupting noise in a noisy speech signal to improve its quality and intelligibility with low computational cost. In particular, there is a need for a system and method to be applied in situations where there is only one single recording device, in contrast to when there is a separate recording device for the background noise. The implication of one recording device is that the input signal is mono.

Figure 1:
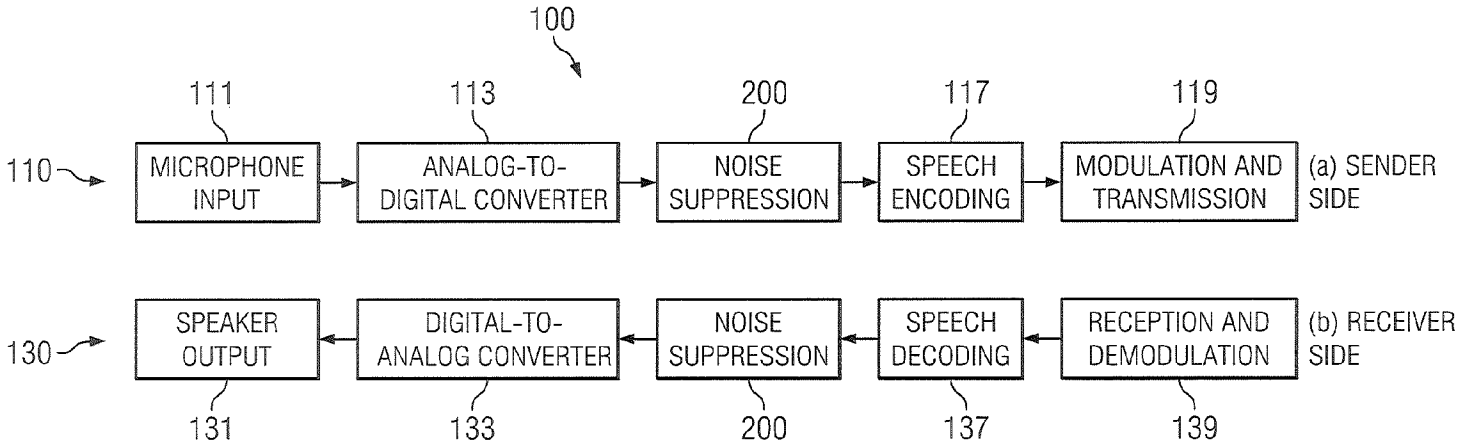
FIG. 1 shows two possible applications for one embodiment of the present disclosure in a telecommunication system.

FIG. 1 shows a communication system 100. The communication system 100 includes a sender 110 and a receiver 130. The sender 110 can include one or more software modules and one or more hardware modules. The examples of the sender 110 can be a wireless terminal or a wireline phone terminal. The first block diagram shows the sender 110 of the communication system 100, where noise suppression is carried out before the speech is encoded. The sender 110 includes a microphone input unit 111, an analog-to-digital converter (ADC) 113, a noise suppression unit 200, a speech encoding unit 117, and modulation and transmission unit 119.

Figure 2:
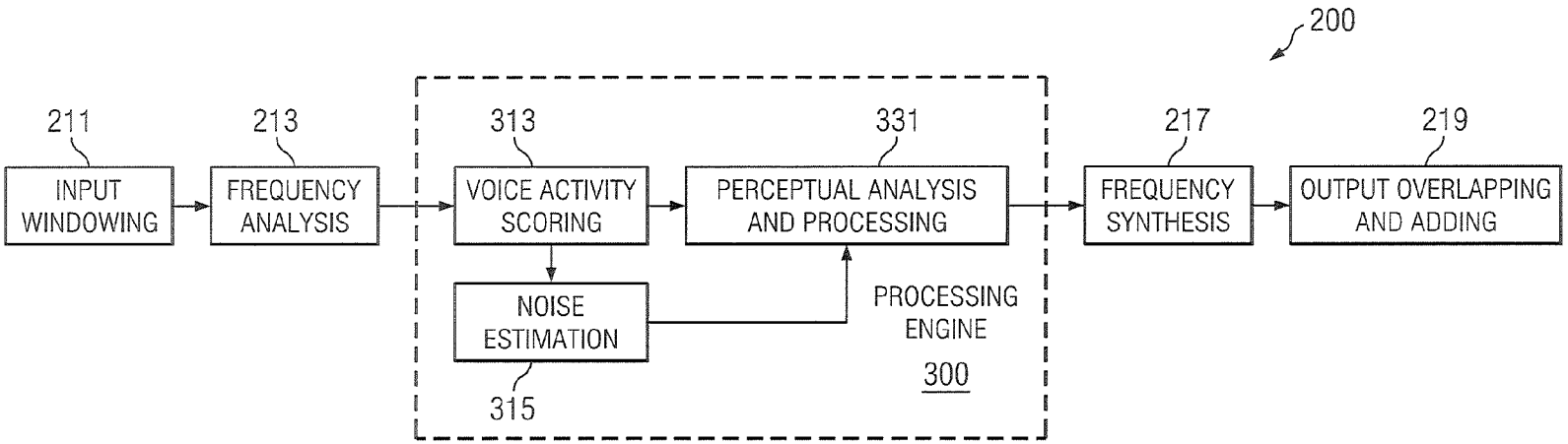
FIG. 2 shows a high-level block diagram of functional modules related to noise suppression according to one embodiment of the present disclosure.
Figure 3:
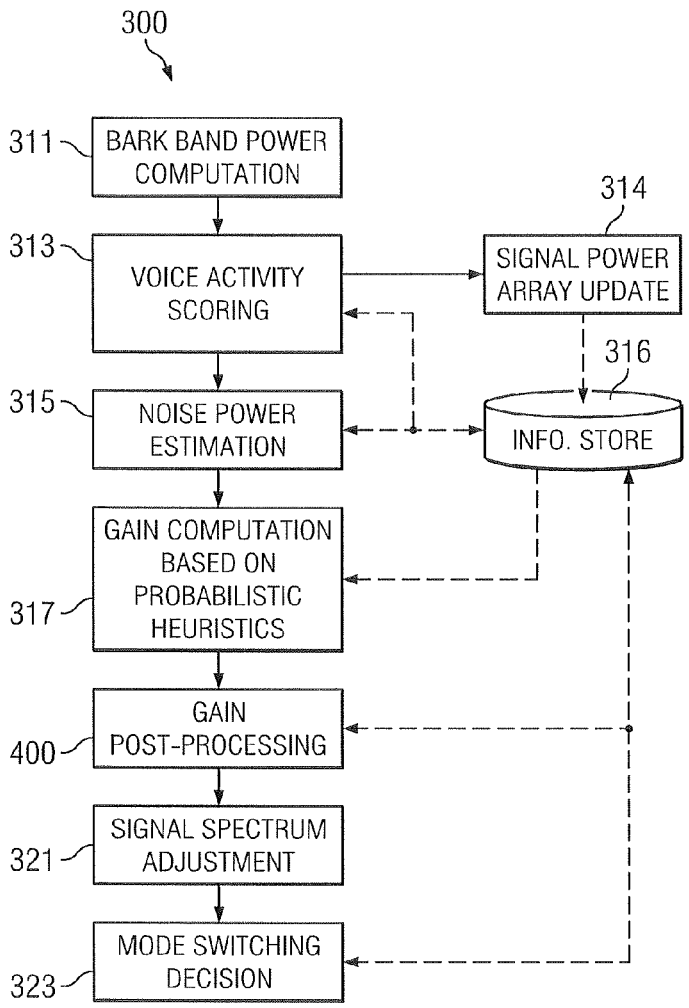
FIG. 3 shows a block diagram of a processing engine for noise suppression according to one embodiment of the present disclosure.

The microphone input unit 111 can receive speech from a speaker and generate analog signals. The ADC 113 converts the analog speech signals to corresponding digital signals. The noise suppression module 200 is configured to suppress noise in the speech signals before the speech signals are transmitted to the receiver 130. More details of the noise suppression module 200 are shown in FIG. 2 and FIG. 3 and described therein. The input to noise suppression module 200 is in Pulse Code Modulation (PCM) format obtained by the ADC 113. Typical sampling frequency, denoted as Fs, is 8 KHz, though 16 KHz or other frequencies are sometimes used. After the noise suppression operation at the noise suppression module 200, the speech signals in digital format are encoded at the speech encoding module 117. Then the encoded speech data are modulated and transmitted to the receiver by the modulation and transmission module 119.

The receiver 130 can include one or more software modules and one or more hardware modules. The examples of the sender 110 can be a wireless terminal or a wireline phone terminal. The receiver 130 can include a reception and demodulation unit 139, speech decoding unit 137, a noise suppression module 200, a digital-to-analog converter (DAC) convert 133, and a speaker output unit 131. The noise suppression module 200 on the receiver 130 is identical to the one on the sender 110. In one embodiment, noise suppression is carried out after the signal is decoded by the decoding unit 137, also operating in PCM format. The operations at the receiver 130 are the mirror image of those at the sender 110. The reception and demodulation unit 139 receive and demodulate the speech data and then the speed decoding module 137 decodes the speech data into the PCM format. The noise suppression module 200 is configured to suppress the noise in the speech data. The DAC 133 converts the speech data back to the analog format to be played back by the speaker output unit 131.

With the assumption that there is only one microphone for recording the input signal, these two use cases are the same, regardless of any effects caused by the speech codec used. Hence, one embodiment of the present disclosure should work equally well in either scenario. Practically, it is preferred to carry out noise suppression at the sender 110; because the receiver often has no information as to whether the received signal had its noise suppressed at the sender 110 and simply reapplying noise suppression may compromise the speech quality. Thus, following the well-established principles of Wiener filtering, a method according to one embodiment of the present disclosure works in the frequency domain to suppress the noise. To make the processing more closely related to human perception and to keep cost low in terms of memory and computation, processing is done in the psychoacoustically motivated bands, for example the Bark bands as shown in Table 1 below.

TABLE 1

Bark Bands

| BAND GROUP | BARK BAND NUMBER | FREQUENCY RANGE (HZ) |
|---|---|---|
| Low Range | 1 | 0~100 |
| | 2 | 100~200 |
| | 3 | 200~300 |
| Middle Range | 4 | 300~400 |
| | 5 | 400~510 |
| | 6 | 510~630 |
| | 7 | 630~770 |
| | 8 | 770~920 |
| | 9 | 920~1080 |
| | 10 | 1080~1270 |
| | 11 | 1270~1480 |
| | 12 | 1480~1720 |
| | 13 | 1720~2000 |
| | 14 | 2000~2320 |
| High Range | 15 | 2320~2700 |
| | 16 | 2700~3150 |
| | 17 | 3150~3700 |
| | 18 | (3700~4000 for Fs = 8 KHz) 3700~4400 |

TABLE 1-continued

| Bark Bands | | |
|---|---|---|
| BAND GROUP | BARK BAND NUMBER | FREQUENCY RANGE (HZ) |
| | 19 | 4400~5300 |
| | 20 | 5300~6400 |
| | 21 | 6400~7700 |
| | 22 | 7700~8000 |

As known, intelligibility of speech is derived largely from the pattern of voice formants distribution, and the relative positioning of the first two formants is normally sufficient to distinguish a human sound from others. Hence the frequency range covering the first two or three formants is identified as more important, also referred to as speech band. Accordingly the psychoacoustic bands are divided into three groups: Low Range (LR) for bands below the speech band, Middle Range (MR) for those in the speech band, and High Range (HR) for those above the speech band. An example of such a classification is shown in Table 1. Processing is discriminatively carried out for bands in different groups according to one embodiment of the present disclosure.

Figure 11:
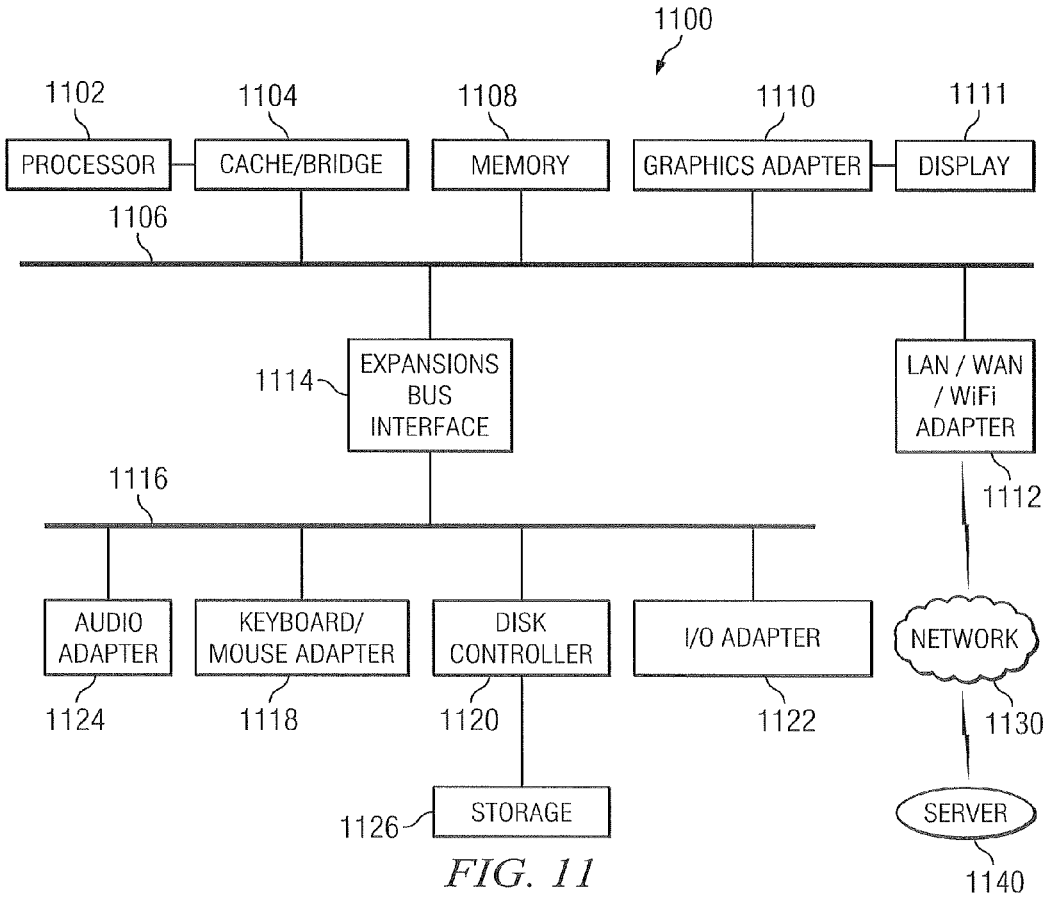
FIG. 11 depicts a block diagram of a generic controller 1100 for a wireless terminal according to one embodiment of the present disclosure.

FIG. 2 shows a high-level functional block diagram of a noise suppression module 200, according to one embodiment of the present disclosure. The noise suppression module 200 can include one or more software modules and one or more hardware module. In one embodiment, the noise suppression module 200 is implemented in the generic controller 1100 as illustrated in FIG. 11. The noise suppression module 200 includes an input windowing module 211, a frequency analysis module 213, a processing engine 300, a frequency synthesis module 217, and an output overlapping and adding module 219. The process engine 300 includes a voice activity scoring module 313, a perceptual analysis and processing module 331, and a noise estimation module 315. In one embodiment, the method works in block-processing mode; that is, input stream is segmented into overlapping frames, each frame processed separately, and output obtained by overlap-and-adding the processed frames.

The input Windowing module 211, in one embodiment, segments the input signal into overlapping frames. Overlapping ratio is typically chosen to be half; that is, the first half of the current frame is in fact the second half of the previous frame. A window is multiplied with the frame to ensure smooth transition from frame to frame, and to suppress high frequencies introduced by segmentation.

The frequency analysis 213 then transforms the windowed frame to the frequency domain using a frequency analysis method. Fast Fourier Transform (FFT) is a common choice of frequency analysis method. For a sampling frequency of 8 KHz, a frame size of 256 samples is often a good trade-off between frequency resolution and time resolution.

The processing engine 300 is configured to analyze and identify the noise in the input signal spectrum and then suppress the noise. The processing engine 300 includes a voice activity score module 313, a perceptual analysis and processing module 331, and a noise estimation module 315. These component modules of the processing engine 300 for noise suppression are depicted in more details in FIG. 3 and FIG. 4 and described therein.

The frequency synthesis module 217 and the output overlap-and-add module 219 are configured to the transform processed signal spectrum back to time-domain, after the noise suppression operations on the input signal spectrum. The frequency synthesis and overlap-and-add module 219 may use an inverse transformation method of frequency analysis to convert the processed signal spectrum in frequency domain back to the time domain. If FFT was used for frequency analysis, then Inverse FFT is applied. The processed time domain signal of the current frame is aligned with the corresponding part of the previously processed frame and they are summed to produce the output. The overlapping region of current frame with the next frame is saved for synthesis of next output frame.

FIG. 3 shows a block diagram of a processing engine 300 for noise suppression according to one embodiment of the present disclosure. FIG. 3 shows more details of the same processing engine 300 than the one shown in FIG. 2. The processing engine 300 can include one or more software modules and one or more hardware module. In one embodiment, the processing engine 300 is implemented in the generic controller 1100 for a wireless terminal, as illustrated in FIG. 11. The processing engine 300 includes a Bark bank power computation module 311, a voice activity scoring module 313, a noise power estimation module 315, and a gain computation module 317. The processing engine 300 also includes a gain post-processing module 400, a signal spectrum adjustment module 321, and a mode switching decision module 323. The processing engine 300 also includes a signal power array updating module 314 and an information store 316. The information of a certain number of past frames may be stored in the information store 316 to facilitate modules such as Voice Activity Scoring (VAS) module 313, the noise power estimation 315, the gain computation module 317 and the gain post-processing module 319.

The voice activity scoring (VAS) module 313 is configured to compute a continuous score to rate the possibility of the presence of speech. In a Wiener filtering approach, noise power is estimated for adjusting the noisy signal spectrum. To facilitate efficient estimation of noise power in a quasi-/non-stationary speech signal, it is desired to take advantage of voice activity information. The VAS module 313 is particularly useful in making the estimation of noise power fuzzy so as to eliminate the risk of wrong classification by a traditional voice activity detector (VAD) that outputs binary decisions.

The VAS module 313 computes a score in a continuous range such that a low score indicates the input frame highly likely being a noise-only frame and a high score indicates the input frame highly likely being a frame dominated by speech. This scoring scheme is found advantageous over the binary decision scheme of a conventional Voice Activity Detector (VAD) due to the quasi- and non-stationary nature of speech signals.

The noise power estimation module 315 follows the principle of temporal tracking. Making use of the observation that noise power normally changes slowly. According to one embodiment of the present disclosure, taking advantage of the score output by the VAS, the noise estimation module 315 can respond quickly to non-stationarity in the input, in addition to being able to cope with signals that are neither noise-only nor speech-dominated with a very high likelihood.

Then the gain computation module 317 may compute a gain for each frequency according to a heuristic, based on the estimated noise power. The heuristic may be expressed as follows. As the ratio of the noisy signal frequency component power to the estimated noise frequency component power grows, the possibility of that frequency component of the noisy signal being noise decreases, and when the ratio is large enough the frequency component can eventually be taken as containing speech only.

Figure 4:
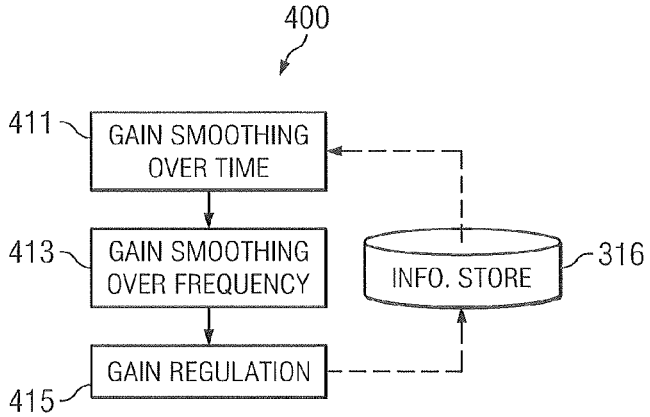
FIG. 4 shows an block diagram for a gain post-processing module according to one embodiment of the present disclosure.

Then the gain post-process module 400 performs a post-gain processing on the computed gain for each frequency, with the estimated noise power, and according to probabilistic heuristics. The post-gain processing module 400 makes sure the processed signal sound natural. FIG. 4 shows details of the post-gain processing module 400.

Then the signal spectrum adjustment module 321 adjusts the noisy signal spectrum by multiplying the final gains with the magnitudes of the noisy signal spectrum to attenuate noise. This in effect suppresses the noise to achieve improved quality and intelligibility of speech. Then the mode switching decision module 323 checks mode switching criteria for each frame to decide a mode for next frame. To cope with changing environments, the noise suppression engine may operate in and automatically switch between two modes: NORMAL for adequate noise and NOISY for extremely high noise.

The following sections describe these operations of the processing engine 300 for noise suppression in more detail. These operations are performed by the Bark band power computation module 311, the VAS module 313, the signal power array updating module 314, the noise power estimation module 315, the gain computation module 317, the gain post-processing module 400, the signal spectrum adjustment module 321 and the mode switching decision module 323.

The Bark band power computer module 311 computes the signal bank power in psychoacoustic bands. Equation 1 below represents the power in the psychoacoustic bands, where $X_{i,k}$ denotes the ith frequency sample of kth frame after frequency analysis, j is the band index, k is the frame index, $B_j$ is the set of frequency indices of the jth band according to Table 1 above.

$$X_{j,k}^{b} = \sum_{i \in B_j} |X_{i,k}|^2 \quad \text{(Equation 0)}$$

The voice activity scoring module 313 assigns a score, denoted as $\text{FRAME_SCORE}_k$, to the current frame k to indicate the possibility of existence of speech. It is continuous and non-negative, with a larger value indicating higher possibility of containing speech. $\text{FRAME_SCORE}_k$ is computed based on a combination of two metrics: Score_1 taking into account the shape of the signal's power spectrum, and Score_2 the total power. Specifically, Score_1 is a function of the number of MR bands of the current frame having greater power than corresponding MR bands of the previously estimated noise scaled by a factor. A pseudo code is shown below to illustrate how the signal power and noise power are compared to obtain the input to the function for computing Score_1.

```
X_{j,k}^b : Signal power of psychoacoustic band j of current frame
k (see Equation 0)
D_{j,k-1}^b : Estimated noise power of psychoacoustic band j of
previous frame k-1 (see (Equation 4)
τ : A constant scaling factor, preferably in the range of
1.5 to 4.
cnt = 0;
for each band j in the MR
    If X_{j,k}^b > τ*D_{j,k-1}^b,
        cnt = cnt + 1;
    end
end
```

Figure 5:
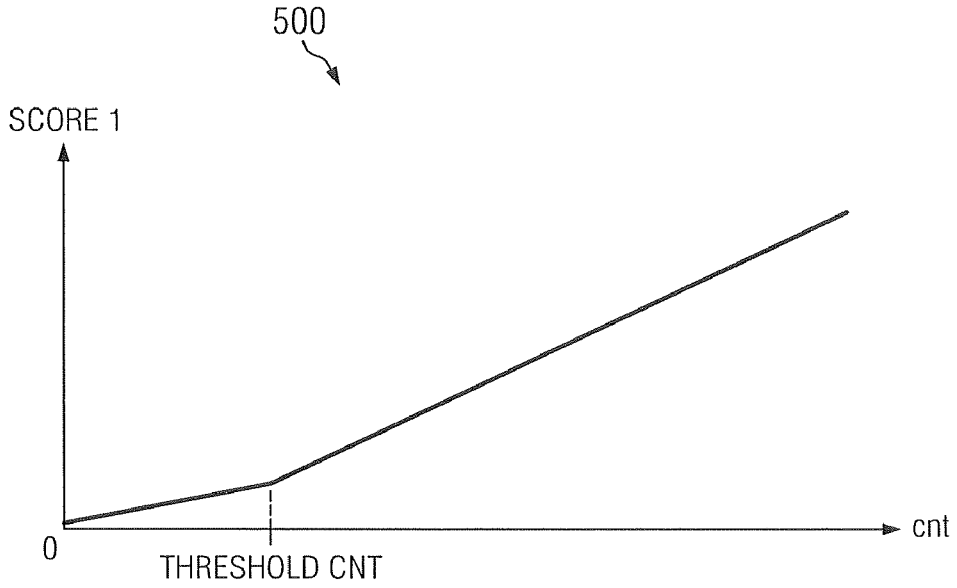
FIG. 5 shows an exemplary curve of a voice activity score component as a function of a voice band count.

FIG. 5 shows a curve that results from a function into which the computed value cnt that is fed to finally obtain Score_1. In FIG. 5, threshold_cnt controls the turning point above which the curve, hence Score_1, increases more quickly as cnt increases.

Figure 6:
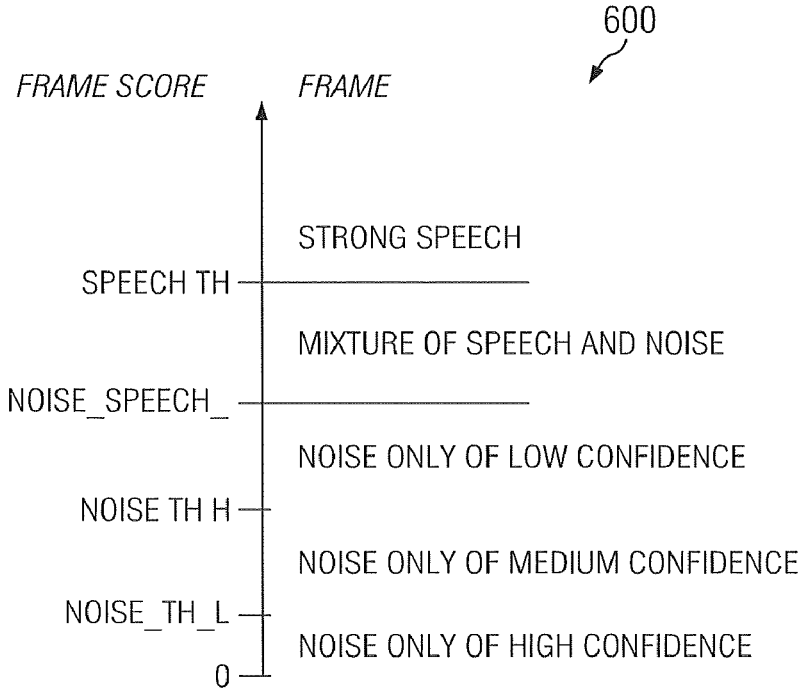
FIG. 6 shows an exemplary frame core distribution and associated frame characteristics according to one embodiment of the present disclosure.

Score_2 is related to the ratio of total power of the current frame to that of the previous estimated noise.

$$\text{Score_2} = \theta * \frac{\sum_j X_{j,k}^b}{\sum_j D_{j,k-1}^b} \quad \text{(Equation 1)}$$

Where θ is a constant and takes a value in the range of 0.25 to 0.5. The final score is a weighted sum of these two:

$$\text{FRAME_SCORE}_k = w_1 * \text{Score_1} + w_2 * \text{Score_2} \quad \text{(Equation 2)}$$

where $w_1$ and $w_2$ are weights assigned to these two scores, respectively, and $w_1+w_2=1$. Typically, $w_1=0.5$ and $w_2=0.5$ are adequate. With the above derivations for FRAME_SCORE, its range can be divided into, a few sections, each section corresponding to certain characteristics. FIG. 6 shows a few sections and their corresponding characteristics. Both the function curve of Score_1 (as shown in FIG. 5) and the constant θ for Score_2 depend on which mode it is operating in, to better cope with different characteristics of different environments. Generally, it tends to assign a higher score when operating in NOISY mode than in NORMAL mode, as speech characteristics are more difficult to identify with high level noise.

The noise power estimation module 315 estimates the noise power in psychoacoustic bands that are more closely related to human perception than individual frequencies. The estimation works in one of two modes that are adapted to different signal characteristics: one mode for noise-like signal, and the other for speech-like signal.

A frame is classified as noise-like if $\text{FRAME_SCORE}_k$<=NOISE_SPEECH_TH, and as speech-like otherwise. The threshold NOISE_SPEECH_TH can be tuned with test signals.

For a speech-like frame, the estimation is based on the principle of temporal tracking; that is, noise power in each band changes slowly in time and is closely related to the recent frames having small power. Specifically, for each band, the signal power of N recent frames is sorted in ascending order, and a portion of the array from the beginning is averaged as the estimated noise power in this band of the current frame. The total number of recent frames, N, for which the signal power is stored, may correspond to a time interval of about 200 to 400 milliseconds. Mathematically, estimated noise power for band j is $$W_{j,k}^b = \frac{1}{M_j} \sum_{q \in F_j} X_{j,q}^b \quad \text{(Equation 3)}$$

where $F_j$ is the set of recent frame indices selected for band j, and $M_j$ is the total number of elements in $F_j$. In general, $M_j$ is different for different bands and $M_j$<N. For simplicity, $M_j$ can be dependent on band group. The final estimated noise power for band j of the current frame k, denoted as $D_{j,k}^b$, is smoothed with that of the previous frame k−1, denoted as $D_{j,k-1}^b$, by $$D_{j,k}^b = \alpha * D_{j,k-1}^b + (1-\alpha) * W_{j,k}^b \quad \text{(Equation 4)}$$

where α is an adaptive smoothing factor to eliminate abrupt change, and is derived from a predefined constant NOISE_SMOOTH_FACTOR, which is greater than 0.5, and the normalized deviation of total power of current frame from the mean total power of a few recent frames. Specifically, (Equation 5)

$$\alpha = \mathrm{MAX}(\mathrm{NOISE_SMOOTHING_FACTOR},\ 1 - \mathrm{ABS}(dif)),$$

where $$dif = \frac{X_{j,k}^{b} - avg}{avg}$$

$$avg = \frac{1}{P}\sum_{q \in G} X_{j,q}^{b}$$

and G is the set of frame indices for P most recent frames.

For a noise-like frame, it is desirable to take advantage of the high proportion of noise in the noisy signal for estimating noise, so as to quickly respond to change in the signal, for example, the disappearance of voice. Hence, the signal power is taken as the estimated noise power:

$$W_{j,k}^{b} = X_{j,k}^{b} \quad \text{(Equation 6)}$$

Figure 7:
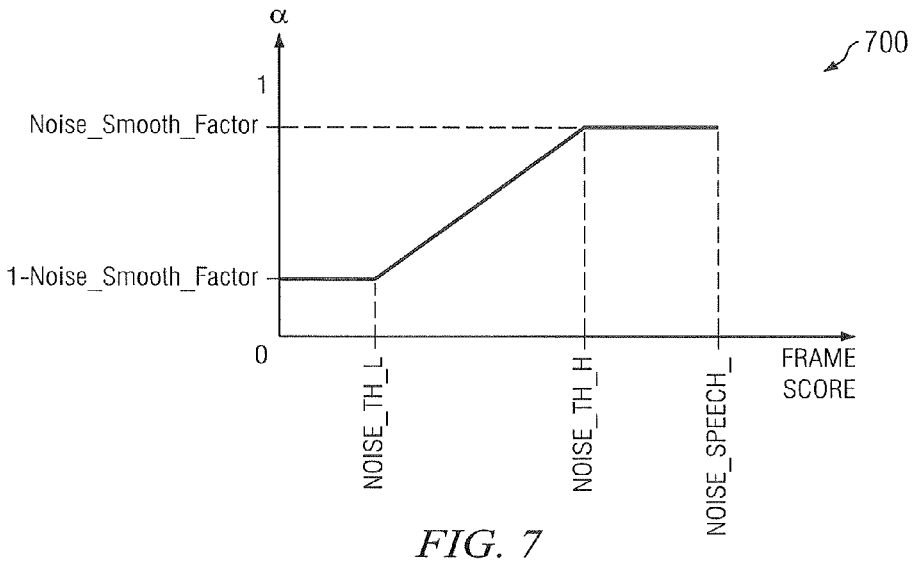
FIG. 7 shows an exemplary curve for the noise time smoothing factor for different constants according to one embodiment of the present disclosure.

In addition, to avoid dramatic difference in estimated noise power due to the binary noise-like/speech-like decision when $\mathrm{FRAME_SCORE}_k$ is close to NOISE_SPEECH_TH, the smoothing factor $\alpha$ gradually changes from the 1-NOISE_SMOOTH_FACTOR to NOISE_SMOOTH_FACTOR as $\mathrm{FRAME_SCORE}_k$ increases from a lower score threshold NOISE_TH_L to a higher score threshold NOISE_TH_H, as depicted in FIG. 7. The final noise power is updated following (Equation 4. It can be seen that when $\mathrm{FRAME_SCORE}_k$ is close to NOISE_SPEECH_TH, either slightly above or below it, the weight given to is close to NOISE_SMOOTH_FACTOR, resulting in a similar estimated noise power regardless of the binary noise-like/speech-like decision.

Due to the principle of temporal tracking for estimating noise power, when storing the noisy signal power, the previous noise power is substituted for the actual noisy signal power, scaled with a factor for correction, if $\mathrm{FRAME_SCORE}_k$>SPEECH_TH, because a speech-dominated frame does not give good estimation of noise power.

The gain computation module 317 computes a gain for each frequency component I according to a probabilistically driven heuristics.

For computing the gains of psychoacoustic band j, a threshold $\mathrm{THRES}_j$ is first computed based on the estimated noise power $D_{j,k}^{b}$:

$$\mathrm{THRES}_j = \mathrm{SCALE_FACTOR}_k * \beta_j * D_{j,k}^{b} / C_j \quad \text{(Equation 7)}$$

Where $C_j$ is the total number of frequency components in band j, $\beta_j$ is a frequency-dependent constant, and $\mathrm{SCALE_FACTOR}_k$ is a variable dependent on the current frame's $\mathrm{FRAME_SCORE}_k$ and the previous frame's $\mathrm{FRAME_SCORE}_{k-1}$. If either the current frame or the previous frame is speech-dominated, i.e., $\mathrm{FRAME_SCORE}_k$>SPEECH_TH or $\mathrm{FRAME_SCORE}_{k-1}$>SPEECH_TH, then $\mathrm{SCALE_FACTOR}_k$=1; otherwise $\mathrm{SCALE_FACTOR}_k$ is proportional to the ratio of the total power of the current frame to that of the previous frame's estimated noise, i.e., $$r = \frac{\sum_j X_{j,k}^{b}}{\sum_j D_{j,k-1}^{b}}.$$

Figure 8:
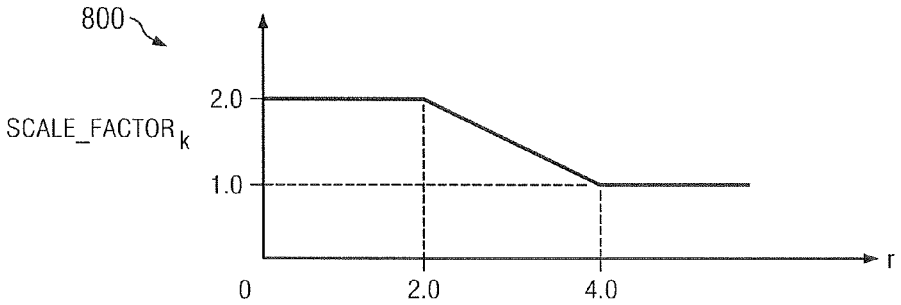
FIG. 8 shows an exemplary curve of a scale factor as a function of an estimate noise according to one embodiment of the present disclosure.

An example curve to compute $\mathrm{SCALE_FACTOR}_k$ with r is illustrated in FIG. 8.

For a frequency component i with power equal or larger than the threshold, i.e., $|X_{i,k}|^2 \geqq \mathrm{THRES}_j$, it is considered as having very strong speech content so that noise is masked by speech according to psychoacoustic principles, and a unity gain is assigned, i.e. $G_{i,k}=1$.

Figure 9:
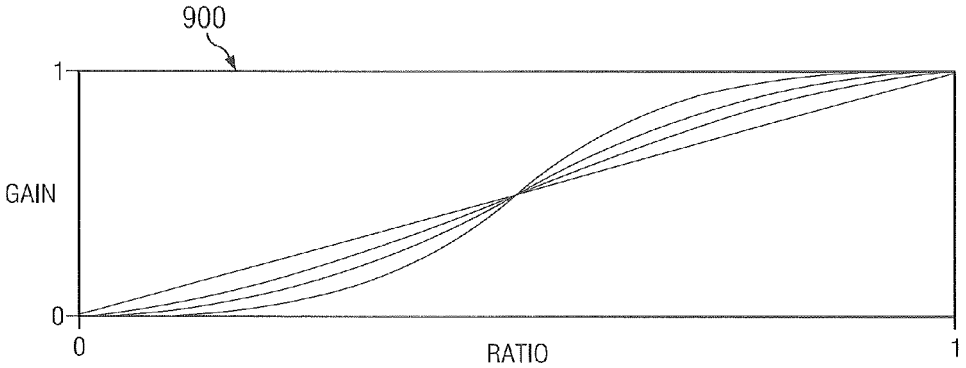
FIG. 9 illustrates exemplary curves of gain vs. a ratio of noise power to threshold according to one embodiment of the present disclosure.

For a frequency component i with power less than the threshold $|X_{i,k}|^2 < \mathrm{THRES}_j$, the gain $G_{i,k}$ is computed according to a probabilistically driven curve that can be either linear or non-linear. FIG. 9 shows some example curves that can be used. For non-linear curves, a turnover point is identified, below which the gain is attenuated and above which it is amplified. Different degrees of attenuation/attenuation amplification correspond to different probabilistic heuristics in the treatment of noise. Further improvement can be achieved by assigning the same gain to frequencies in one psychoacoustic band if they are in the LR or when current frame is found to be noise-only. This also simplifies computation. In summary, $G_{i,k}$ is computed as $$G_{i,k} = \begin{cases} f\left(\dfrac{X_{j,k}^{b}/C_j}{THRES_j}\right), & \text{if } j \in LR \text{ or } \mathrm{FRAME_SCORE}_k \leq \mathrm{NOISE_TH_L} \\ f\left(\dfrac{|X_{i,k}|^2}{THRES_j}\right), & \text{otherwise} \end{cases} \quad \text{(Equation 8)}$$

where $i \in B_j$ $B_j$ is the set of frequency indices of the jth band according to Table 1, $C_j$ is the total number of frequency components in band j, and f( ) is a function designed according to probabilistic heuristics as mentioned above.

FIG. 4 shows the component modules of the gain post-processing module 400. The gain post-processing module 400 further processes the computed gains to ensure the quality of processed signal and may include a gain time smoothing module 411, a gain frequency smoothing module 413, and, and a gain regulation 415.

The gain time smoothing module 411 can smooth the gains in the time domain. As known, a filter that changes too fast in the time domain results in unnaturalness in the processed signal and in some cases may introduce musical noise. Hence, the gains are carefully smoothed in the time axis. The gain time smoothing module 411 takes into account the signal temporal characteristics by detecting if the current frame is a release; if so, the time smoothing factor is adjusted according to $G_{i,k-1}$, based on the heuristic that the higher $G_{i,k-1}$ is the more likely frequency i corresponding to a decaying voice and hence is given a higher value to better preserve voice. If not a release, is assigned with the lowest value.

The time smoothing formula is expressed as shown by Equation 9 below.

$$G'_{i,k} = \gamma_i * G_{i,k-1} + (1-\gamma_i) * G_{i,k} \quad \text{(Equation 9)}$$

where $\gamma_i$ is a frequency-dependent time smoothing factor, preferably in the range of 0.3 to 0.7.

The gain smoothing over frequency smoothing module 413 can mitigate artifacts introduced into the computed gains. The computed gains are all positive real numbers, and they correspond to a zero-phase filter which is symmetric in the time domain. If the filter impulse response has significant energy near its beginning (and tail by symmetry), when convolving with the windowed input signal, some artifacts may be introduced into the output. This can be mitigated by multiplying the filter impulse response with a smoothing window. In the frequency domain, this can be accomplished by filtering gains $\{G'_{i,k}\}$ with a linear-phase low-pass filter. A finite impulse response (FIR) filter of order as low as four is normally adequate.

The gain regulation module 415 can maintain the gains within a range between a minimum value and a maximum value to avoid loss of information. Since the bands in MR are considered the most important for perception, they should not be suppressed more than bands in LR and HR. Let GAIN_MAX be the maximum gain in MR, i.e., GAIN_MAX=MAX $(G'_{i,k})$ where the frequency i is in MR. Then gains in LR and HR should not exceed GAIN_MAX.

Figure 10:
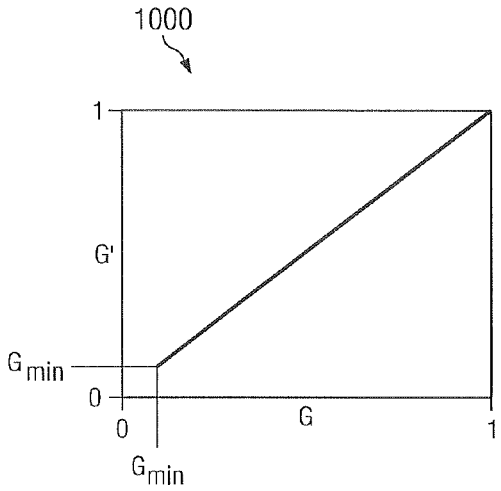
FIG. 10 illustrates an exemplary gain regulation curve according to one embodiment of the present disclosure.

To avoid completely losing information, gains are maintained above a threshold $G_{min}$, (i.e., $G'_{i,k}$ $G_{min}$. The threshold $G_{min}$ determines the maximum suppression of noise and it also serves as an injection of comfort noise. Furthermore, no gain should exceed unity, $G'_{i,k}$ 1, the gain. The gain regulation curve 1000 is depicted in FIG. 10 according to one embodiment of the present disclosure.

The noisy signal spectrum adjustment module 321 can adjust the noisy signal spectrum by multiplying the post-processed gain $G'_{i,k}$ with respective frequency component $X_{i,k}$ to produce a filtered spectrum $\{Y_{i,k}\}$ as shown by Equation 10 below.

$$Y_{i,k}=G'_{i,k}*X_{i,k} \quad \text{(Equation 10)}$$

The mode switching decision module 323 is configured to determine a mode of operation based on the empirical observation and then switch into the mode. In an environment with adequate noise, a significant portion of non-noise frames (if $FRAME_SCORE_k$>NOISE_TH_H, see FIG. 6) are in fact speech-dominated frames (if $FRAME_SCORE_k$>SPEECH_TH). Hence, the mode is switched from NORMAL to NOISY when this portion falls below a threshold. On the other hand, when this portion is too large, mode is switched from NOISY to NORMAL. The exact proportion can be tuned with the actual test signals that comprise streams of normal noise and streams of high noise.

Accordingly, one embodiment of the present disclosure provides a system and method for adaptively suppressing noise in a speech signal with little memory and computation. The method and system can adaptively suppress additive noise in a speech signal for improved quality and intelligibility. Input signal is segmented into overlapping frames and each frame is processed in the frequency domain. Voice activity of an input frame is rated with a score in a continuous range to adapt other processing modules. Noise power is estimated in psychoacoustically motivated bands, making the processing closely related to human perception. With the voice activity score and estimated noise power, a gain for each frequency is computed according to probabilistic heuristics, smoothed in the time axis and frequency axis, and regulated before adjusting the noisy signal spectrum, to ensure the naturalness of the processed speech. To cope with changing environments, the method can operate in and automatically switch between two modes: one for adequate noise and the other for extremely high noise. This method is very efficient in terms of memory and computation as some processing is done in a psychoacoustic scale which has only about 20 bands.

FIG. 11 depicts a block diagram of a generic controller 1100 for a wireless terminal. In the generic controller 1100, an embodiment of the processing engine 300 can be implemented. The generic controller 1100 depicted includes a processor 1102 connected to a level two cache/bridge 1104, which is connected in turn to a local system bus 1106. Local system bus 1106 may be, for example, a peripheral component interconnect (PCI) architecture bus. Also connected to local system bus in the depicted example are a main memory 1108 and a graphics adapter 1110. The graphics adapter 1110 may be connected to display 1111.

Other peripherals, such as local area network (LAN)/Wide Area Network/Wireless (e.g. WiFi) adapter 1112, may also be connected to local system bus 1106. Expansion bus interface 1114 connects local system bus 1106 to input/output (I/O) bus 1116. I/O bus 1116 is connected to keyboard/mouse adapter 1118, disk controller 1120, and I/O adapter 1122. Disk controller 1120 can be connected to a storage 1126, which can be any suitable machine usable or machine readable storage medium, including but not limited to nonvolatile, hard-coded type mediums such as read only memories (ROMs) or erasable, electrically programmable-read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices.

Also connected to I/O bus 1116 in the example shown is audio adapter 1124, to which speakers (not shown) may be connected for playing sounds. Keyboard/mouse adapter 1118 provides a connection for a pointing device (not shown), such as a mouse, a trackball, and a trackpointer, etc.

Those of ordinary skill in the art will appreciate that the hardware depicted in FIG. 11 may vary for particular embodiments. For example, other peripheral devices, such as an optical disk drive and the like, also may be used in addition or in place of the hardware depicted. The depicted example is provided for the purpose of explanation only and is not meant to imply architectural limitations with respect to the present disclosure.

The generic controller 1100 in accordance with an embodiment of the present disclosure includes an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft Windows™, a product of Microsoft Corporation located in Redmond, Wash. may be employed if suitably modified. The operating system is modified or created in accordance with the present disclosure as described.

LAN/WAN/Wireless adapter 1112 can be connected to a network 1130 (not a part of generic controller 1100), which can be any public or private data processing system network or combination of networks, as known to those of skill in the art, including the Internet. The generic controller 1100 can communicate over network 1130 with server system 1140, which is also not part of generic controller 1100, but can be implemented, for example, as a separate generic controller 1100.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus for adaptively suppressing noise in an input signal frequency spectrum derived from overlapping input frames, the system comprising:

a psychoacoustic power computation module configured to compute a noisy signal power in psychoacoustic bands;

a voice activity scoring module configured to compute a probabilistic score for a presence of a speech;

a noise estimation module configured to estimate a noise power in the psychoacoustic bands based on information of past frames, the probabilistic score, and the computed noisy signal power;

a gain computation module configured to compute a gain for each frequency, based on a probabilistic heuristic, the probabilistic score and the information on the past frames; and a gain post-processing module configured to perform a gain time smoothing, a gain frequency smoothing, and a gain regulation for the computed gain.

2. The apparatus of claim 1, further comprising a windowing module configured to segment input speech signals into the overlapping input frames, wherein an overlapping ratio of 50 percent is used;

a frequency analysis module configured to convert the input frames into the input signal frequency spectrum;

a data store configured to store the information on the past frames;

a mode switching module configured to switch into one of a plurality of operation modes based on a noise level, wherein the operation modes include a normal mode and a noisy mode;

a noisy spectrum adjustment module configured to adjust the input signal frequency spectrum by attenuating a noise in the input signal frequency spectrum based on the post-processed gain from the gain post-processing module;

a frequency synthesis module configured to convert the adjusted input signal frequency spectrum to a time domain; and an overlap-and-add module configured to create a final output signal based on the adjusted input signal frequency spectrum.

3. The apparatus of claim 2, wherein first two or three formants of the input signal frequency spectrum are considered speech bands.

4. The apparatus of claim 1, wherein the input speech signals are mono speech signals sampled at a frequency equal or less than 16 KHz.

5. The apparatus of claim 1, wherein the noisy signal power of the psychoacoustic bands is based on a summation of squared frequency magnitudes of each of the psychoacoustic bands.

6. The apparatus of claim 1, wherein the probabilistic score is based on a weighted sum of a first score and a second score, wherein the first score is based on a relative power of a speech band of a current frame and a power of an estimated noise in a previous frame, and the second score is based on a total power of the current frame and a total power of the estimated noise in the previous frame.

7. The apparatus of claim 1, further comprising a signal classification module configured to classify each of the input frames into one of a noise-only frame, a non-noise frame, a noise-like frame, a speech-like frame, and a speech-dominant frame, according to the probabilistic score.

8. The apparatus of claim 1, wherein the noisy spectrum adjustment module is further configured to suppress the noise by adjusting the input signal frequency spectrum via multiplying the post-processed gain with respective frequency components.

9. A method for adaptively suppressing a noise in an input signal frequency spectrum derived from overlapping input frames, the method comprising:

computing a noisy signal power in psychoacoustic bands;

computing a probabilistic score for a presence of a speech;

estimating a noise power in the psychoacoustic bands based on information of past frames, the probabilistic score, and the computed noisy signal power;

computing a gain for each frequency, based on a probabilistic heuristic, the probabilistic score and the information on the past frames; and post-processing the computed gain by performing a gain time smoothing, a gain frequency smoothing, and a gain regulation on the computed gain.

10. The method of claim 9, further comprising segmenting input speech signals into the overlapping input frames;

converting the overlapping input frames into the input signal frequency spectrum;

storing the information on the past frames into a datastore;

classifying each of the input frames into one of a noise-only frame, a non-noise frame, a noise-like frame, a speech-like frame, and a speech-dominant frame, according to the probabilistic score;

deciding on one of a plurality of operation modes based on a noise level, wherein the operation modes include a normal mode and a noisy mode;

adjusting the input signal frequency spectrum by attenuating a noise in the input signal frequency spectrum based on the post-processed gain;

converting the adjusted input signal frequency spectrum to a time domain; and creating a final output signal based on the adjusted input signal frequency spectrum.

11. The method of claim 10, wherein for the speech-like frame, the noise power of a psychoacoustic band is based on an average of M smallest noisy signal powers in the that psychoacoustic band of previous N frames with $M<N$.

12. The method of claim 9, wherein for the noise-like frame, the noise power of a psychoacoustic band is based on the signal power of the psychoacoustic band.

13. The method of claim 9, wherein computing the gain further comprises computing the gain for each frequency based on a threshold, assigning the gain for every frequency a one if a signal power of the frequency is above the threshold, and assigning the gain for each frequency a same value assigned to other frequencies of the same psychoacoustic band if the current frame is a noise-only frame.

14. The method of claim 13, wherein the threshold is based on a frequency-dependent constant, a variable scaling factor, and the estimated noise power of the frequency, wherein the variable scaling factor is proportional to a ratio of a total power of the current frame to a total power of estimated noise of a previous frame.

15. The method of claim 9, wherein the estimated noise power of the frequency is based on an averaged estimated noise of powers of all frequencies of the psychoacoustic band.

16. The method of claim 13, wherein the gain time smoothing comprises smoothing the computed gain with a second computed gain of a previous frame.

17. The method of claim 13, wherein the gain frequency smoothing comprises applying a linear-phase filter to the computed gain.

18. The method of claim 13, wherein the gain regulation comprises keeping the computed gain for a non-speech band smaller than a maximum gain in the speech band and keeping the computed gain above a minimum threshold.

19. A computer program stored on a machine readable storage medium such that when executed by a processor is operable to:

convert overlapping input frames into an input signal frequency spectrum;

compute a noisy signal power in psychoacoustic bands;

compute a probabilistic score for a presence of a speech;

estimate a noise power in the psychoacoustic bands based on information of past frames, the probabilistic score, and the computed noisy signal power;

compute a gain for each frequency, based on a probabilistic heuristic, the probabilistic score and the information on the past frames; and post-process the computed gain by performing a gain time smoothing, a gain frequency smoothing, and a gain regulation on the computed gain.

20. The computer program of claim 19, wherein the computer program when executed by a processor is further operable to:

segment input speech signals into overlapping input frames;

store the information on the past frames into a datastore;

decide on one of a plurality of operation modes based on a noise level, wherein the operation modes include a normal mode and a noisy mode;

adjust the input signal frequency spectrum by attenuating a noise in the input signal frequency spectrum based on the post-processed gain;

convert the adjusted input signal frequency spectrum to a time domain; and create a final output signal based on the adjusted input signal frequency spectrum.

* * * * *